United States Patent [19]

Makepeace

[11] 4,001,054

[45] Jan. 4, 1977

[54] PROCESS FOR MAKING METAL PIPE

[76] Inventor: Charles E. Makepeace, 2314 Elmira Drive, Ottawa, Ontario, Canada, K2C 1H4

[22] Filed: Apr. 10, 1974

[21] Appl. No.: 459,611

[52] U.S. Cl. ..... 148/16.5; 148/34; 148/39; 148/127; 148/145; 148/150; 148/151

[51] Int. Cl.[2] ..... C21D 9/14

[58] Field of Search ..... 148/143, 145, 150, 151, 148/127, 16.5, 34, 39

[56] References Cited

UNITED STATES PATENTS

| | | | |
|---|---|---|---|
| 2,292,363 | 8/1942 | Crawford | 148/150 |
| 2,295,272 | 9/1942 | Somes | 148/143 |
| 2,412,802 | 12/1946 | Coriolis | 148/16.5 |
| 3,408,237 | 10/1968 | Gulliksen et al. | 148/39 |

*Primary Examiner*—R. Dean
*Attorney, Agent, or Firm*—W. Charles Kent

[57] ABSTRACT

Metal pipe or tubing having increased strength and toughness in a direction transverse to its axis, designed to prevent fractures and inhibit fracture propagation, for example in pipelines carrying fluids such as natural gas or oil. The pipes have localized sections spaced from their ends which have been toughened and strengthened by heat treating or some other known method of toughening and strengthening to a yield strength in excess of 60,000 p.s.i. The heat treating process requires subjecting the localized sections of the pipes to heat them, through their entire wall thickness, to the austenitizing temperature, after which the relevent sections are quenched using a liquid or gaseous quenching medium. The sections are then tempered to provide the desired degree of strength and toughness. These lengths of pipe may be welded in a conventional manner.

10 Claims, 10 Drawing Figures

Fig. 7a
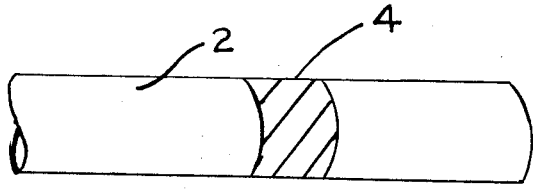
Fig. 7b
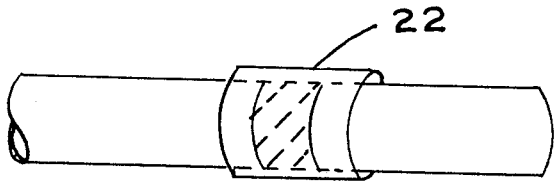
Fig. 7c
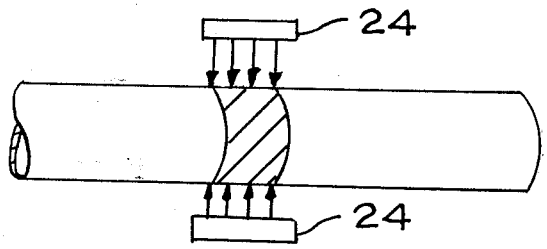
Fig. 7d
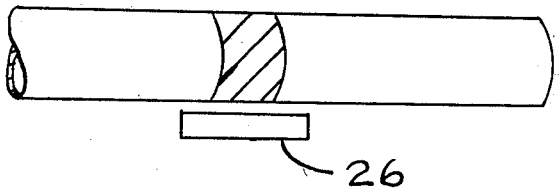
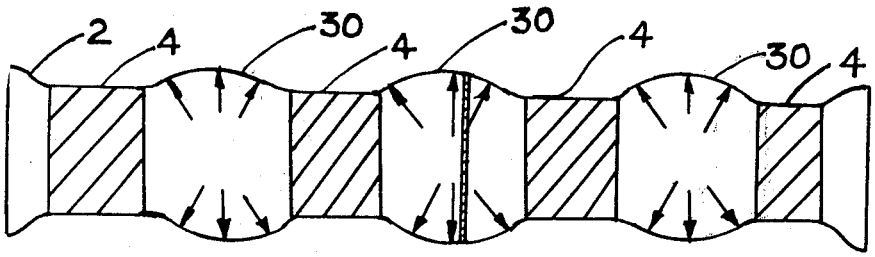
Fig. 8

PROCESS FOR MAKING METAL PIPE

BACKGROUND OF THE INVENTION

While pipelines, for example, for natural gas and oil, are relatively safe systems for transporting such products, nevertheless such pipelines have been known to fail often with tragic economic and human loss. From time to time such failures are the direct result of human activity in the vicinity of the pipeline, for example, when earth moving equipment at a construction site accidentally strikes a section of a pipeline. Not so commonly known is the fact that operational pipelines have failed from other than such human causes, always with dramatic suddenness and often with tragic and serious loss to life and property. For example, a 12 inch natural gas pipeline broke unexpectedly in the main business district of Malton, Ontario, Canada, on Oct. 25, 1969. One person was killed and numerous others were injured when this pipeline burst and gas flowing therefrom burst into flames. The flames were out of control for several hours and caused extensive damage to Malton's business section. In another example, at 3:40 p.m. on Sept. 9, 1969, a 14 inch pipeline carrying natural gas at a pressure of more than 780 p.s.i.g. ruptured in a residential subdivision 3¼ miles north of Houston, Tex. It was determined that the probable cause of the accident was the fracturing of a length of pipe along a weak zone. The fracture travelled 46 feet. One hundred and six houses were damaged, property damage was estimated at $500,000. and nine people were injured, two seriously. Another time, during the 1960's, in what has been called the "Great Lakes Pipeline Failure", at least 1 mile of natural gas transmisson line pipe south of Lake Superior suddenly burst, again with substantial economic loss. This 168-mile 36-inch diameter natural gas pipeline operated by the Great Lakes Gas Transmisson Company extends from Emerson, Manitoba, to Sarnia, Ontario, passing through the states of Minnesota, Wisconsin and Michigan.

It has been determined through extensive and costly research on pipelines, that some of these failures have been caused by pipeline fractures which have developed from cracks which have appeared in operating pipelines. Cracks have formed when gases, for example, are transported under pressure in such pipelines and such cracks have travelled to anywhere from a few feet to 1 mile or more along the pipeline. Where the pipeline transported liquids, this distance has been much less. Extensive tests have been carried out in the United States, sponsored by the American Gas Association to determine the nature and causes of, and solutions for such failures. Results of this research have been reported by the American Gas Association in "Symposium on Line Pipe Research (a progress report on Project NG-18 being carried out by the Pipeline Research Committee at Battelle Memorial Institute)" and "Fourth Symposium on Line Pipe Research". As a result of this research, it has been concluded that the initiation and propagation of cracks in operational pipelines are significantly reduced by increasing the yield strength and toughness of the pipelines. This research has also determined that as the temperature of the pipeline decreases, the initiation of fractures and their rate of propagation increases. As well, it has been determined that the danger of such fractures occurring in operational pipelines increased as the diameter of the pipeline increases and as the load pressure of the pipeline increases. Thus, the dangers apparent with the 48 and 60 inch diameter pipelines presently being constructed and contemplated for transmisson of gas and oil in the arctic can be readily understood; such pipelines, because of their size and because of their operational temperatures are much more prone to the initiation of these fractures. When the load pressure of a pipeline is high, for example in transmission line pipe, or is increased, for example where increased flow of gas through a pipeline is required, then "hoop stress", acting circumferentially throughout the pipeline, is an important factor. When hoop stress becomes greater than yield strength, then the danger of fracture of the pipeline becomes serious. Thus, a minimum yield strength is prescribed by Government standards for a given pipe to be used in the pipeline, which yield strength is higher than would be required for the highest pressure normally exerted by a fluid in the pipeline.

It is obvious from the above comments relating to research which has been done on pipeline failures that, to reduce the likelihood of such failures due to cracks and to reduce the rate of crack propagation, the yield strength and toughness of unit pipes for a pipeline should be increased. It is known that to increase the strength and toughness of steel pipes, the pipe may be heated to above its austenitizing temperature, quenched and then tempered to bring the steel to the desired degree of strength. Practical difficulties, however, are encountered with such a method in that large furnaces and quenching baths must be constructed so that the entire pipe may be treated. These difficulties are compounded with larger pipes, for example of the 48 inch to 60 inch diameter, so that furnaces and baths for such sizes of pipes are at the present time not commercially available. With heat treatment of such larger pipes, distortion also becomes a serious problem. As well, energy requirements for heating and tempering the entire pipe unit are very great.

In addition, it has been found as a practical matter that steel which has been strengthened to over 60,000 or 70,000 p.s.i. is extremely difficult to weld throughout its length during manufacture of pipe or, in the form of pipes, end to end in the field. Normal field welding of pipes does not require heating of the ends of the pipe beforehand or heating of the weld zone after the pipe has been welded. To weld such high strength steel, the weld zone must be pre-heated to 1° to 200° F. and post-heated after welding. As well, this method requires special welding wire or welding rods and takes a long period of time for each weld. Also, specially trained personnel are needed. One such pipeline, an experimental natural gas pipeline, 1200 feet in length and 36 inches in diameter was constructed during the 1960's by the Columbia Gas System, Columbus, Ohio, U.S.A. Thus, where the entire length of pipe is heat treated to a yield strength in excess of 70,000 p.s.i., in order to minimize crack initiation and propagation in transmission line pipe, the ends of the pipes so treated are either incapable of being successfully welded by any known acceptable conventional process or may be welded with great difficulty.

Other methods of increasing the overall yield strength and toughness of units of pipe in order to resist the formation and propagation of such pipeline fractures might be considered. One method involves winding high strength steel wire around the pipe to be strengthened. Of course this method is very expensive and time consuming, requiring special reinforcing wire and special machinery for wrapping the wire around the pipe. Another suggested method would require the welding of steel bands about the pipe in order to reinforce it. Where the pipe unit has been previously heat treated to a desired degree of strength and toughness, the heat from the welding process may well adversely affect this pipeline by reducing its strength. As well, this process again is expensive and cumbersome.

It is an object of the present invention to provide a steel pipe or tubing having greater resistance to crack initiation or propagation than steel pipe or tubing presently known, which pipe or tubing may be welded in the field in a conventional manner without the difficulties experienced with welding steel pipe or tubing having high yield strength. It is a further object of this invention to provide a more economical and more efficient method of strengthening and toughening steel pipes and tubing in order to resist such crack initiation and propagation.

SUMMARY OF THE INVENTION

In accordance with the invention, a continuous section of a length of steel pipe or tubing spaced from the ends thereof, is strengthened to a transverse yield strength which may be between 60,000 p.s.i. to 300,000 p.s.i. This section is subjected to locaized heat treatment so that the section is heated throughout its entire wall thickness to a desired temperature which may be in the range of 816° to 1,204° C. The section is then quenched and tempered, by localized heating, to provide the desired degree of strength and toughness. One or more of such strengthened sections may be centered or spaced along the length of the pipe between its ends. The section or sections must circumscribe each length at least once, and for example may be cylindrical or spiral. The process may be carried out on pipe already heat treated throughout its length, for example to 70,000 p.s.i. yield strength.

The localized section of pipe or tubing subjected to the strengthening treatment is spaced from the ends of the pipe length a sufficient distance so that conventional welding of the pipe will be possible.

Pipe treated in this way has improved ability to withstand internal pressures greater than, for example, 50 p.s.i., and greater ability to prevent and reduce crack initiation and propagation. The pipe is capable of withstanding higher pressures without failure and of reducing the velocity of cracks which form.

In its broadest concept, this invention also envisages subjecting such localized sections of pipe to a localized diffusion process having as its result the introduction of another chemical element into the steel to strengthen the localized section.

By the process according to this invention, savings in energy consumption and energy wastage where the heat treatment process is used, and in materials where chemical treatment is used, are enormous since only portions of, and not the entire pipe are treated. Considerably larger diameters, for example up to 60 inches and more of pipe or tubing can be treated using localized treatment zones of this process. Where heat treatment is used, localized heat treatment and tempering furnaces, as well as localized quenching can be effected avoiding the practical difficulties experienced with known heat treatment processes on small or large diameter pipes or tubing. Pipes which have been treated throughout their length to any degree of strength and toughness by any method may then be treated by the process according to this invention in a localized section thereof to further increase the overall strength and toughness of the pipe.

With respect to welding operations, pipes according to the present invention have the advantage that circumferential welding of one such pipe length to another in the field does not interfere with the strengthened portions of the pipe length: where conventional pipes heat treated in their entirety are so welded, the welding operation causes the heat-treated metal at the ends of the pipe to weaken. Also, pipes containing one or more cylindrical sections having yield strength greatly in excess of 70,000 p.s.i. can be welded together in a conventional manner where the localized sections are spaced from the ends of the pipe where welding takes place. Thus, pipe heat treated throughout its length to say 60,000 p.s.i. yield strength having a centered localized section which has been heat treated to a yield strength over 70,000 p.s.i. can be readily welded in a conventional manner.

Where more than one heat treated cylindrical section is spaced along the length of a pipe, the overall yield strength and toughness of the pipe is increased so that a higher operating pressure for the pipeline can be achieved (i.e. successive high strength rings served to increase the net yield strength of the pipe). Where a pipeline is subjected to severe stress for a short period of time, the very high yield strength cylindrical sections of the pipe units prevent failure of the pipeline by sharing the hoop stress which is now distributed between the base pipe material and the treated cylindrical sections.

The invention is particularly applicable to automatic submerged arc-welded transmission line pipe.

BRIEF DESCRIPTION OF THE DRAWINGS

Other objects and advantages of the invention will become apparent upon reading the following detailed description and upon reference to the drawings in which:

FIG. 7 is a schematic drawing of a process of chemically strengthening a section of pipe according to the present invention;

FIG. 8 is a schematic drawing illustrating several lengths of pipe according to the present invention in a pipeline operating under overstressed conditions;

Figure 1:
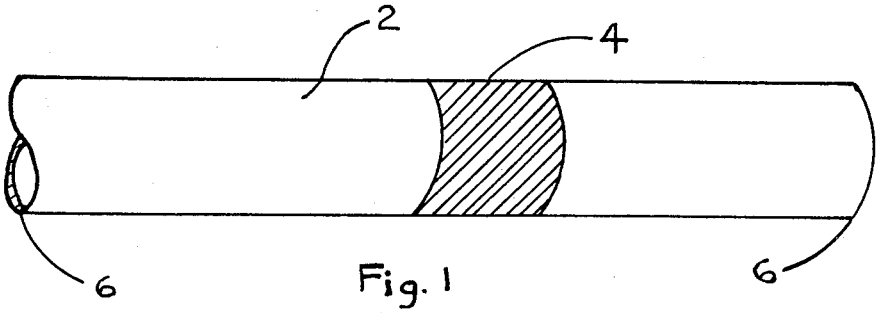
FIGS. 1, 2 and 3 are schematic drawings of lengths of pipe having heat treated sections according to the present invention.

Similar reference numerals in the drawings refer to similar features. While the invention will be described in connection with specific example embodiments and processes, it will be understood that it is not intended to limit the invention to those embodiments and methods. On the contrary, it is intended to cover all alternatives, modifications and equivalents that may be included within the spirit and scope of the invention as defined by the appended claims.

DETAILED DESCRIPTION OF THE INVENTION

Figure 2:
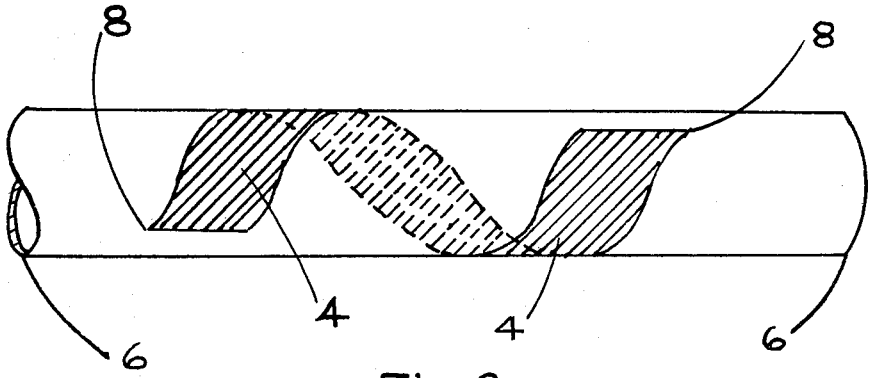
Figure 3:
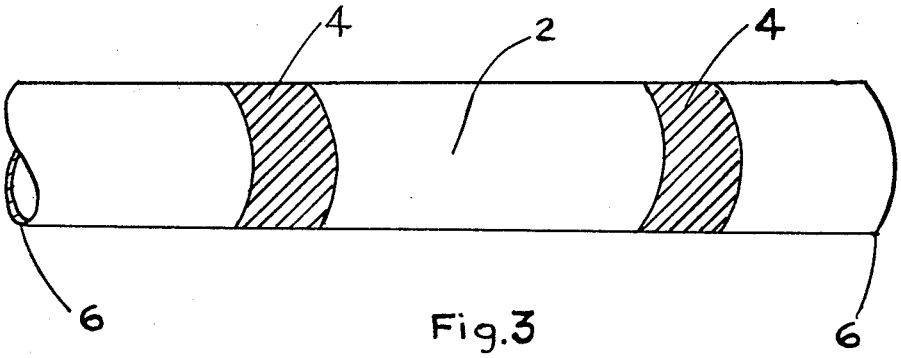

Turning first to FIG. 1, there is shown a pipe length 2 having a localized cylindrical section 4 centrally disposed between ends 6. Section 4 has a yield strength of between 60,000 to 300,000 p.s.i., and has a width sufficient to provide resistance against crack initiation and propagation in the section. Section 4 is positioned sufficiently far away from ends 6 that the welding of the ends of the pipe to other pipe ends will not adversely affect the yield strength of this section, and the length of tubing may be conventionally welded. In the length of pipe illustrated in FIG. 2, strengthened section 4 is spirally disposed along the pipeline, the ends 8 of strengthened section 4 being a sufficient distance from pipe ends 6 to permit the pipe to be conventionally welded. FIG. 3 illustrates a length of pipe having two cylindrical or ring-like strengthened sections spaced from ends 6 and from each other along pipe length 2.

Figure 4:
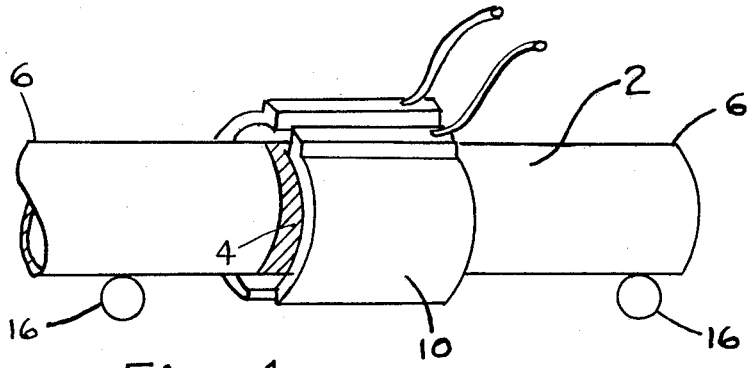
FIG. 4 is a perspective view of a length of pipe being heat treated according to the present invention.
Figure 5:
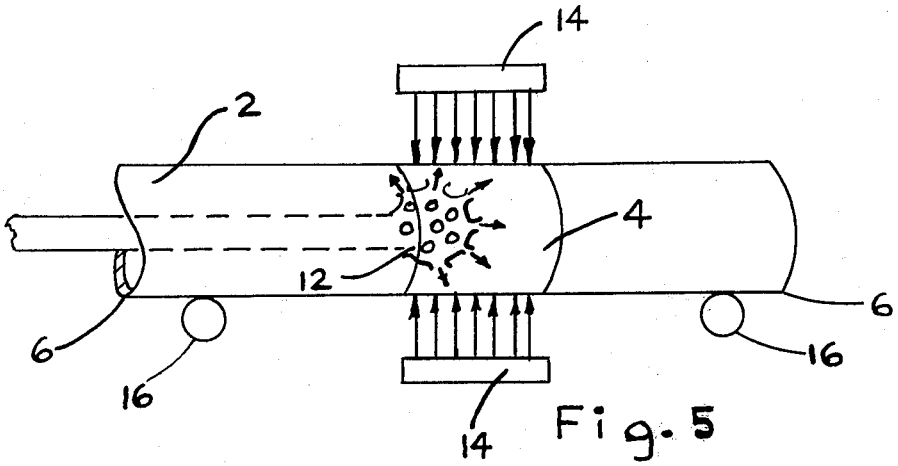
FIG. 5 is a schematic drawing of the heat treated length of pipe illustrated in FIG. 4 being quenched.

As shown in FIGS. 4 and 5 where a cylindrical section of the pipe is subjected to the strengthening process, the cylindrical section 4, which may be, for example, one to ten feet in length, located between the ends 6 of pipe length 2, is subjected to heat treatment (FIG. 4) by means of an induction resistance furnace 10 to heat the entire wall thickness to a temperature in the range 816° to 1,204° C (above austenitizing temperature). Alternatively, flame heating may be used to heat treat section 4. This is followed, as illustrated in FIG. 5, by subjecting heat treated section 4 to inside and outside quenching shown schematically by 12 and 14 respectively. Inside and outside quenching may be conducted separately or simultaneously using a liquid or gaseous quenching medium. The chemical composition and diameter and wall thickness of the pipe will determine the rate at which section 4 is quenched.

After quenching, the localized section is tempered or otherwise heat treated to achieve the desired degree of strength and toughness. It will be noted in FIGS. 4 and 5 that, in order to prevent bending or distortion of pipe length during heating or quenching, pipe length 2 is permitted free movement on support rollers 16.

Figure 6:
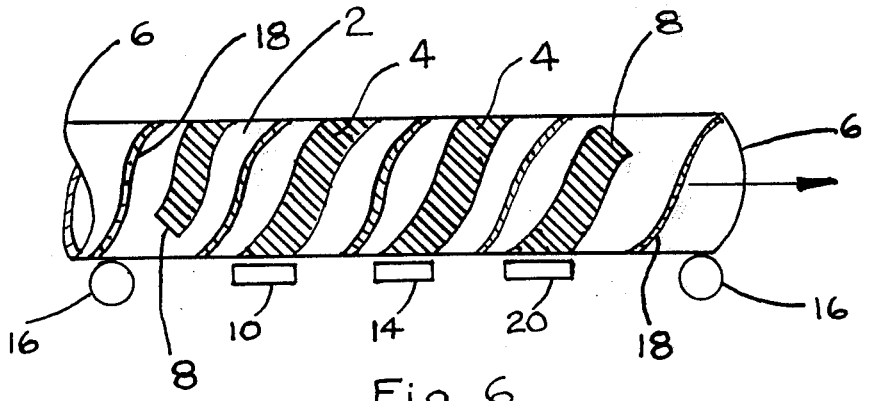
FIG. 6 is a schematic drawing of a length of pipe being treated according to the present invention in a spiral fashion.

Turning now to FIG. 6, a process for continuously treating a length of pipe in order to toughen and strengthen a spiral section of pipe is illustrated. A length of pipe 2 having spiral weld 18 is passed longitudinally, while being rotated axially by rollers 16, by induction heater 10 so that a localized spiral section spaced between spiral weld 18 is heated to its entire wall thickness to between 816° to 1,204° C. This heated spiral section 4 is subsequently passed by quench zone 14 to rapidly reduce the temperature of the section. Finally, the section is passed by an induction coil tempering furnace 20 whereby the section is heated to between 427° to 649° C for toughening and strengthening. It can be readily seen that the process is a continuous one, requiring only that the heating and quenching zones be positioned so that they act in proper sequence on the spiral strip to be strengthened. The spiral strip which is strengthened terminates at ends 8 a distance from ends 6 of pipe length 2 so that it does not interfere with end welding of the pipe by conventional means. Of course the toughened and strengthened spiral strip may include the spiral weld by positioning the heating and quenching zone beside the spiral weld.

In FIG. 7 are illustrated the steps of a process according to the present invention whereby the localized section of pipe is strengthened by introduction of another chemical element into the steel. In Step 1, a cylindrical section 4 of pipe length 2 is sandblasted to remove scale. Section 4 is then passed through case carburizing zone 22 whereby a sufficient quantity of carbon is diffused into this localized section to provide the required carbon content for the ultimately strengthened and toughened section of pipe. The section may then be passed through quenching zone 24 (Step 3) and tempering zone 26 (Step 4) to bring the section to the desired degree of strength and toughness.

Two sections of pipe 2, each having two spaced cylindrical strengthened sections 4 are illustrated in FIG. 8 in an operational pipeline. The pipeline is illustrated as being over-stressed under pressure, and the drawing exaggerates the pipe wall showing internal pressures. The strengthened cylindrical sections, while under stress, are not expanded to the same extent, and act to hold bulges 30 in the adjacent untreated sections in place. Thus, such sections of pipe according to the invention improve the overall ability of the pipe to withstand internal pressures by reducing the amount of overall distortion created in the pipe by such internal pressure.

Figure 9:
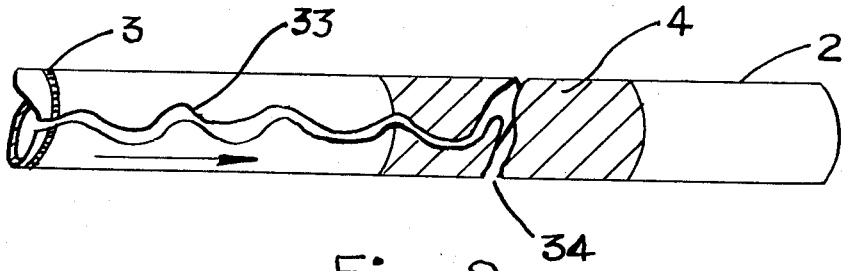
FIGS. 9 and 10 are schematic drawings of a number of lengths of pipe in a pipeline according to the present invention illustrating the length of a crack travelling along the pipeline.
Figure 10:
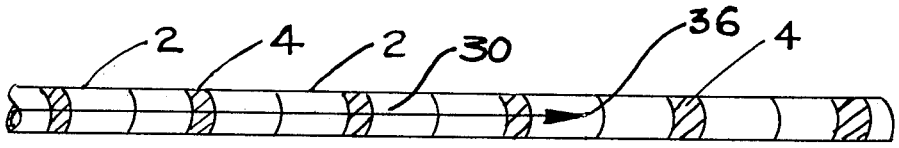

In FIG. 9, a high velocity crack 32 is shown arrested by heat treated section 4 in pipe length 2. Although the pipeline fractures at 34, the crack is prevented from continuing and thus, a very long fracture in the pipeline is prevented. In FIG. 10, illustrating a pipeline made up of a series of pipe lengths 2 having central cylindrically strengthened sections 4, a crack is shown having velocity which is decreased as it passes through successive heat treated cylindrical sections 4 until it is ultimately arrested at point 36.

Thus, it is apparent that there has been provided in accordance with the invention a toughened and strengthened length of steel pipe or tubing and a process for making the same, that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim as my invention:

1. A process for toughening and strengthening a steel pipeline in a direction transverse to its axis to resist crack initiation and propagation, said pipeline being made up of a plurality of coterminous units, which process comprises the steps of:

1. heating a plurality of longitudinal sections of said units through their entire wall thickness to a temperature above austenitizing temperature, each of said sections being spaced from each other when in position in said pipeline and being spaced from the ends of the unit in which it is located a sufficient distance to permit conventional welding of the ends, and each section to circumscribe the pipeline at least once,
2. subjecting each of the said sections to inside and outside quenching to provide quenching throughout its entire wall thickness,
3. tempering each of said sections throughout its entire wall thickness by subjecting each to localized heat and toughening and strengthening each section to a yield strength of between 60,000 to 300,000 p.s.i., and 4. welding the ends of said units together to form said pipeline.

2. A process for toughening and strengthening a steel pipeline in a direction transverse to its axis to resist crack initiation and propagation, said pipeline being made up of a plurality of coterminous units, which process comprises the steps of:

1. carburizing a plurality of longitudinal sections of said units, each of said sections being spaced from each other when in position in said pipeline and being spaced from the ends of the unit in which it is located a sufficient distance to permit conventional welding of the ends, and each section to circumscribe the pipeline at least once, by diffusing a sufficient quantity of carbon into the longitudinal section, during the carburization step, to provide the required carbon content for the ultimately strengthened and toughened section of pipe,
2. subjecting each of said carburized sections to inside and outside quenching to provide quenching throughout its entire wall thickness,
3. tempering each of said carburized sections throughout its entire wall thickness by subjecting each to localized heating, the sections being thereby toughened and strengthened to a yield strength of between 60,000 to 300,000 p.s.i., and
4. welding the ends of said units together to form said pipeline.

3. A process according to claim 2, wherein each section is a cylindrical section centrally located between the ends of a unit.

4. A process according to claim 2, wherein each section is a spiral section of pipe extending between the ends of a unit.

5. A process according to claim 1, wherein a plurality of spaced sections is provided in each of the units whereby increased resistance to the effects of internal pressure is achieved in said units.

6. A process according to claim 1 wherein each section is heat-treated by heating it to a temperature of between about 816° and 1,204° C.

7. A process according to claim 1 wherein each section is tempered by heating it to a temperature of between about 427° and 649° C.

8. A process according to claim 1 wherein each section is a cylindrical section centrally located between the ends of a unit.

9. A process according to claim 1 wherein each section is a spiral section of pipe extending between the ends of a unit.

10. A process according to claim 1 wherein a localized induction furnace is used for heat treatment of the section.

* * * * *